United States Patent [19]

Cantley

[11] 4,432,379

[45] Feb. 21, 1984

[54] METHOD AND APPARATUS FOR HANDLING A COIN HOLDER

[76] Inventor: Ross H. Cantley, 577 Essex Rd., Beaconsfield, Quebec H9W 3V8, Canada

[21] Appl. No.: 482,439

[22] Filed: Apr. 6, 1983

[51] Int. Cl.[3] ..... G07D 9/00

[52] U.S. Cl. ..... 133/1 R; 206/0.82

[58] Field of Search ..... 133/1 A, 1 R; 206/0.82, 206/0.84; 133/8 R, 8 A, 8 B

[56] References Cited

U.S. PATENT DOCUMENTS 1,053,704 2/1913 Broadberry ..... 206/0.82

2,909,280 10/1959 Furno et al. ..... 206/0.82

*Primary Examiner*—Stanley H. Tollberg

*Attorney, Agent, or Firm*—Alan Swabey; Robert Mitchell; Guy Houle

[57] ABSTRACT

An apparatus for handling a resilient coin holder of the type having terminal ends and a coin-receiving mouth extending longitudinally thereof and defined by opposed side walls of the holder through which coins are received laterally thereof, comprising in combination frame structure, a first jaw member on the frame structure, the first jaw member adapted to receive and engage with a first side wall of the coin holder when placed on the apparatus, and a second jaw member adapted to receive and engage with a second side wall of the coin holder, the second jaw member being so arranged as to permit movement thereof relative to the first jaw member whereby to displace the first and second side walls relative to one another to permit coins within the holder to be released therefrom. Also disclosed are methods of releasing coins from a coin holder of the above-mentioned type.

20 Claims, 8 Drawing Figures

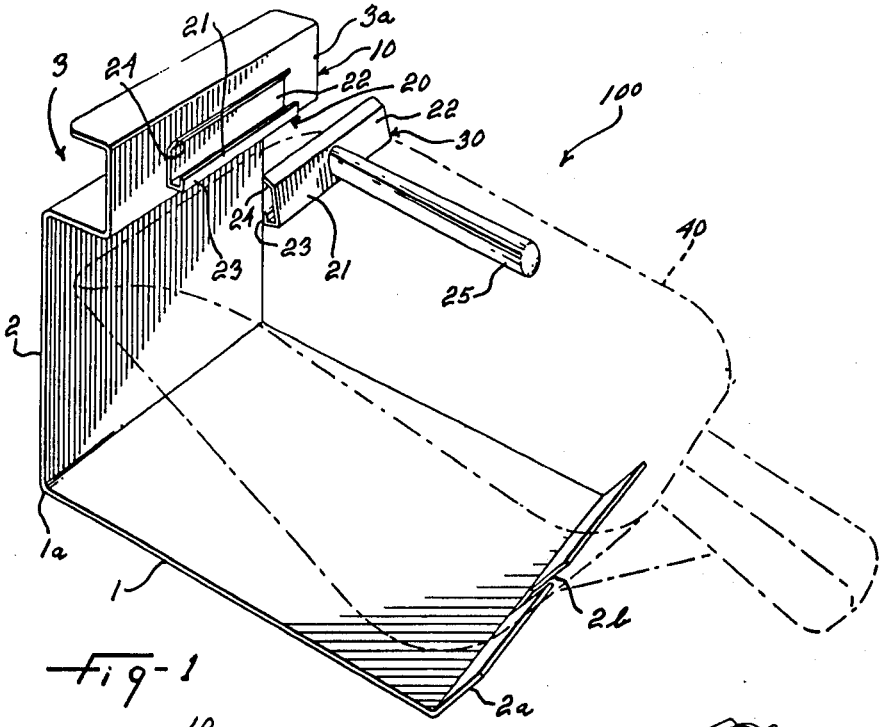
Fig-1
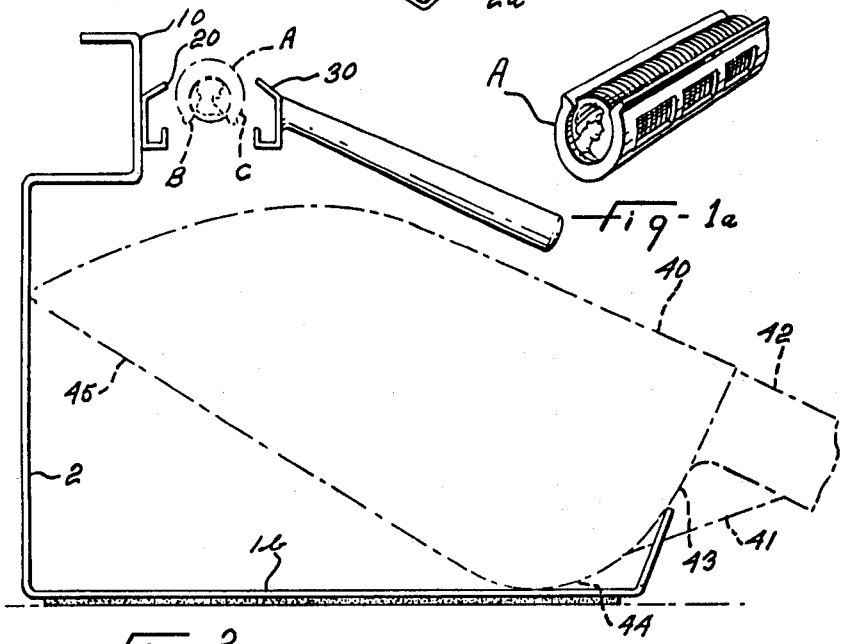
Fig-1a
Fig-2

METHOD AND APPARATUS FOR HANDLING A COIN HOLDER

BACKGROUND OF INVENTION (a) Field of the Invention

The present invention relates to an apparatus for handling coin holders of the type shown in Canadian Patent No. 1,056,343 and corresponding U.S. Pat. No. 4,095,608 or the like, such having a coin-receiving mouth and through which coins are released therefrom.

The present invention also relates to an apparatus for handling a plurality of such coin holders.

The present invention further relates to a method of releasing coins from a coin holder of the aforementioned types.

(b) Description of Prior Art

Substantial convenience in the handling of coins was afforded with the introduction of the coin holders according to Canadian Patent No. 1,056,343. The high efficiency of these holders in retaining the coins, however, demands that they be handled in special ways in order to somewhat efficiently remove the coins therefrom. Such known ways include holding the coin holder between finger and thumb and striking the same against another full holder or cupped hand. Such methods do not ensure the coins are removed in one clean operation or controlled in their movement upon leaving the holder.

SUMMARY OF INVENTION

It is therefore an important aim of the present invention to overcome the aforementioned drawbacks.

It is a further important aim of the present invention to not only overcome the problems associated with the present method of handling such coin holders, but to provide a more efficient handling whereby a person may deal with the emptying of many coin holders at one time, thereby speeding up the coin emptying process.

In one aspect of the present invention, there is provided a method of releasing coins from a coin holder of the type having terminal ends and a coin-receiving mouth extending longitudinally thereof and defined by opposed side walls of the holder through which coins are received laterally thereof, comprising the steps of (1) orienting the coin holder to place the coin-receiving mouth in a downwardly facing direction, (2) engaging respective slides of the coin-receiving mouth with a jaw means apparatus, and (3) operating the jaw means apparatus to displace the respective sides of the coin-receiving mouth to permit coins in the holder to be released therefrom and to move downwardly in a vertical direction.

In a further aspect of the present invention, there is provided a method of releasing coins from a coin holder of the type having terminal ends and a coin-receiving mouth extending longitudinally thereof and defined by opposed side walls of the holder through which coins are received laterally thereof, comprising the steps of (1) orienting the coin holder to place the coin-receiving mouth in a downwardly facing direction, (2) engaging a first side of the coin-receiving mouth with a first jaw means, (3) moving the first jaw means with the coin holder toward a second jaw means, (4) engaging the second jaw means with a second side of the coin-receiving mouth, and (5) moving the first jaw means to displace the respective sides of the coin-receiving mouth to permit coins in the holder to be released therefrom and move in a downwardly vertical direction.

In a still further aspect of the present invention, there is provided an apparatus for handling a resilient coin holder of the type having terminal ends and a coin-receiving mouth extending longitudinally thereof and defined by opposed side walls of the holder through which coins are received laterally thereof, comprising in combination (a) frame means, (b) a first jaw member on the frame means, the first jaw member adapted to receive and engage with a first side wall of the coin holder when placed on the apparatus, and (c) a second jaw member adapted to receive and engage with a second side wall of the coin holder, the second jaw member being so arranged as to permit movement thereof relative to the first jaw member whereby to displace the first and second side walls relative to one another to permit coins within the holder to be released therefrom.

In a further aspect of the present invention, there is provided an apparatus for handling at least two resilient coin holders of the type having terminal ends and a coin-receiving mouth extending longitudinally thereof and defined by opposed side walls of the holder through which coins are received laterally thereof, comprising in combination (a) frame means adapted to receive a plurality of the holders placed linearly in end-to-end arrangement, (b) a first jaw member on said frame means adapted to receive and engage with respective first side walls of the coin holders when placed on the apparatus, and (c) a second jaw member adapted to receive and engage with respective second side walls of the coin holders, the second jaw member being so arranged as to permit movement thereof relative to the first jaw member whereby to displace the respective first and second side walls relative to one another to permit coins within the holders to be released therefrom.

BRIEF DESCRIPTION OF DRAWINGS

The invention is illustrated by way of example in the accompanying drawings, wherein:

FIG. 1 is a perspective view of an apparatus in accordance with the present invention;

FIG. 1*a* is a perspective view of a prior art coin holder, with coins of the type handled by the present apparatus.

FIG. 2 is a side elevational view of the apparatus shown in FIG. 1;

DESCRIPTION OF PREFERRED EMBODIMENTS

Referring now in detail to the drawings, FIG. 1 illustrates an apparatus 100 for handling a resilient coin holder of the type, for example, shown in Canadian Patent No. 1,056,343, such coin holder designated A, having terminal ends and a coin-receiving mouth extending longitudinally thereof and defined by opposed side walls of the holder through which coins are received laterally thereof. Apparatus 100 is seen to include a frame means 10 and a first jaw member 20 on frame means 10, jaw member 20 being adapted to receive and engage with a first side wall B of coin holder A, (best seen in FIGS. 4 and 5) when placed on apparatus 100. Apparatus 100 is further seen to include a second jaw member 30, which, as seen in FIGS. 4 and 5, is adapted to receive and engage with a second side wall C of coin holder A, jaw member 30 being arranged to permit movement thereof relative to jaw member 20 to thus displace side walls B and C relative to one another and to permit coins in the holder A to be released therefrom.

Figure 4:
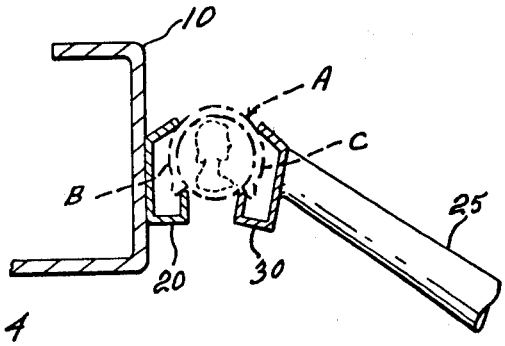
FIG. 4 is a part sectional view taken along line 4—4 in FIG. 3.
Figure 5:
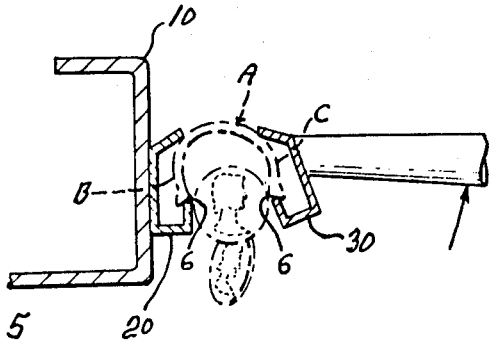
FIG. 5 is a view similar to that of FIG. 4 showing the mouth of a coin holder being displaced by the apparatus according to the invention, to release the coins from the holder.

As seen from FIGS. 4 and 5, jaw members 20 and 30 are oriented on frame 10 when in its working position, such that coin holder A is held with its coin-receiving mouth facing in a downward direction to permit coins released therefrom to drop in a vertically downward direction and be received in container 40, as seen in FIG. 1.

Frame means 10 may comprise any suitable configuration including that shown in FIGS. 1 and 2, illustrating one preferred embodiment. Frame means 10 may be constructed from various suitable materials including steel. Frame means 10 is seen to include a base plate 1 and a vertically disposed wall portion 2 extending upwardly therefrom adjacent peripheral edge 1*a*. As further seen, the free end of wall portion 2 terminates in a channel-like configuration 3 having an outer base face 3*a* overlying base plate 1 in a vertical plane. Outer base face 3*a* is seen to provide a face for mounting and securing jaw member 20. Base plate 1 is tailored to suit the dimensions of container 40, as best seen from FIGS. 1 and 2. Base plate 1 further includes, as seen in FIG. 1, a leg portion 2*a* extending inclined and upwardly therefrom and having a slot 2*b* therein comprising abutment locating means, the purpose of which will become apparent from the description hereinafter.

First jaw member 20, as will be seen from FIG. 2, is of similar shape to that of second jaw member 30. Jaw members 20 and 30 are elongated, the length of such being adapted to extend over the major length of the coin holder A to be serviced by the apparatus 100. In the case of the one preferred embodiment disclosed, jaw members 20 and 30 are of similar length and extend to substantially match the length of a coin holder of aforementioned type for holding 50 one-cent Canadian coins of present kind. Jaws 20 and 30 of the said one preferred embodiment disclosed are noted to adequately service various models of coin holders of aforementioned type presently on the market including the ones for accommodating 50 Canadian ten-cent pieces of present kind and 100 German deutsche mark pieces of present kind, accordingly, coin holders of different lengths. Thus, with the present design of the jaws 20 and 30, the coin holder A may overlap the ends of jaws 20 and 30 without interfering with the operation of the apparatus 100 as discussed hereinafter. Such will be readily appreciated from FIG. 5 clearly showing jaws 20 and 30 engaging the outer face edges 6 of portions B and C of coin holder A.

Jaw 20 comprises an elongated channel 21 having one leg thereof 22 extending to a greater extent than the other leg 23, leg 22 terminating in a leg portion 24 inclined and overlying channel 21.

Jaw 30, it will be noted, comprises similar components to jaw 20, i.e. elongated channel 21 having one leg thereof 22 extending to a greater extent than the other leg 23, leg 22 terminating in a leg portion 24 inclined and overlying channel 21. As seen in FIG. 1, jaw 30 further includes a handle portion 25 comprising an elongated member, one end of which is secured to leg 22 substantially centrally thereof to extend in a direction away from channel 21.

Figure 3:
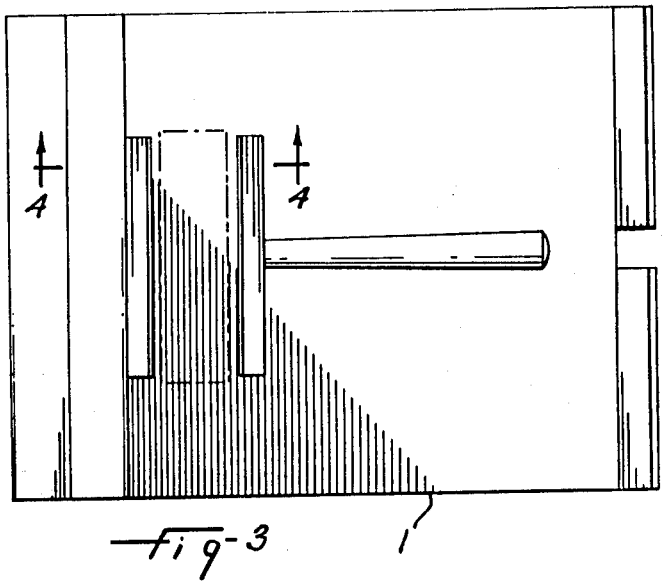
FIG. 3 is a plan view of the apparatus shown in FIG. 1.

Jaw 30 thus comprises a hand tool, a jaw member, which is during operation of apparatus 100 applied to coin holder A and thus is arranged for movement relative to jaw 20. Although not shown in the Figures, it will be realized that jaw 30 may be secured to frame 10 by, for example, a well known toggle arrangement so as to afford similar movement thereof as discussed. Such arrangement would make jaw member 30 captive to frame means 10. Jaw member 20, as best seen in FIG. 3, is located generally central of the width of frame means 10.

Container 40 may be of any well known type including that of the configuration shown, i.e. of the scoop-type having a handle. Preferably, in accordance with the preferred embodiment shown in FIG. 2, the container includes an abutment which may, as shown, comprise a gusset or the like 41 interconnecting the container handle 42 with the adjacent container wall 43, gusset 41 being engageable with slot 2*b* to prevent lateral relative movement of the container 40 in frame means 10. Furthermore, container 40 includes a curved outer wall surface 44 adjacent the lower part of wall 43 to permit the front portion 45 of container 40 to be conveniently tilted upwardly, as shown in FIGS. 1 and 2, such tilting aiding the correct depositing of the coins received from the holder A with a minimum of noise. Container 40 may be of any desired width including as shown, wherein the width extends coincident with the width of frame means 10. Container 40 may also include a cushioned inner bottom surface to further minimize noise during operation of apparatus 100. The position of front portion 45, as seen in FIG. 2, appears to provide a satisfactory operating position of container 40, such being well supported on base plate surface 1*b* via curved portion 44 in conjunction with wall 2 and the free edge of leg 2*a*.

Turning now to the operation of apparatus 100, with container 40 in place on frame means 10, as shown in FIG. 2 for example, a first side wall B of coin holder A is placed in jaw member 20 for engagement therewith, and thereafter jaw member 30 is brought into engagement with a second side wall C of coin holder A, as clearly seen in FIG. 4. Handle 25 is then rotated anticlockwise to displace said first and second side walls, permitting the coins within holder A to be released therefrom, as seen in FIG. 5, the coins dropping into container 40 under gravity. As an alternative, the first side wall C of coin holder A may be first placed in jaw member 30 for engagement therewith using a thumb to hold coin holder A in place thereon, and thereafter engaging jaw member 20 with the second side wall B of coin holder A. The rotation of handle 25 may then proceed as discussed above.

Figure 7:
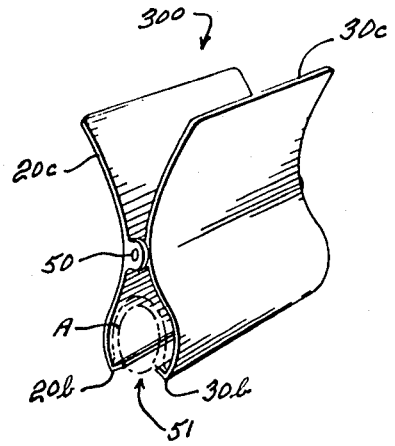
FIG. 7 is an end view of a further embodiment in accordance with the present invention.
Figure 6:
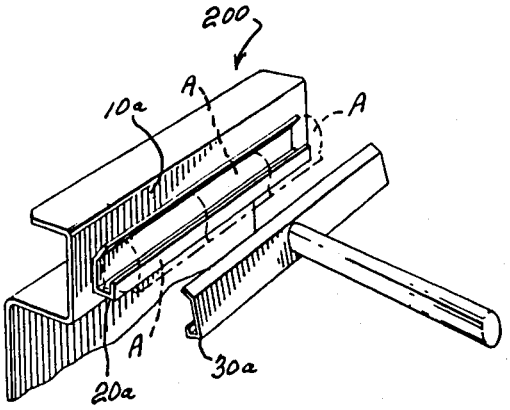
FIG. 6 is a perspective view of part of a further embodiment in accordance with the present invention.

FIGS. 6 and 7 disclose further embodiments in accordance with the present invention.

FIG. 6 discloses an apparatus 200 similar to that shown in FIG. 1 and having a frame means 10*a* and jaw members 20*a* and 30*a*. Apparatus 200 also includes a container (not shown) similar to that shown in FIG. 1.

As will be realized, frame means 10*a* is identical to frame means 10 except for the width required to accommodate a number of coin holders when placed in end-to-end arrangement, as shown in FIG. 6. Likewise, jaw members 20*a* and 30*a* are identical to jaw members 20 and 30 except for their length, such being longer, again to accommodate a number of coin holders as shown. Although the embodiment shown in FIG. 6 illustrates three coin holders A, it will be realized that less could be accommodated, and if frame means 10*a* were widened, more could be accommodated. As may be realized, apparatus 200 is operated in a similar manner to that described in respect of apparatus 100.

FIG. 7 discloses an apparatus 300 comprising a pair of jaw members 20*b* and 30*b* of similar configuration to those of respective jaw members 20 and 30 and interconnected respectively to handle portions 20*c* and 30*c*. Jaw members 20*b* and 30*b* are mounted via a pivot means 50 to provide a jaw 51 adapted to accommodate a coin holder A and which operate in scissors-like fashion upon movement of handle portions 20*c* and 30*c* toward and away from one another. Due to the arrangement provided by pivot means 50, movement of handle portions 20*c* and 30*c* toward one another causes opening of jaw 51. As will be realized, apparatus 300 may be of any desired length and, depending on such, may accommodate one or more coin holders A placed in end-to-end arrangement. Operation of apparatus 300 is straightforward also. A coin holder A or coin holders A to be emptied are inserted endwise into jaw 51, as seen in FIG. 7. Thereafter, the free ends of handle portions 20*c* and 30*c* are moved toward one another to displace the mouth of coin holder A or several, as the case may be, to release the coins therefrom.

I claim:

1. An apparatus for handling a resilient coin holder of the type having terminal ends and a coin-receiving mouth extending longitudinally thereof and defined by opposed side walls of the holder through which coins are received laterally thereof, comprising in combination:

(a) frame means;

(b) a first jaw member on said frame means, said first jaw member adapted to receive and engage with a first side wall of the coin holder when placed on said apparatus; and (c) a second jaw member adapted to receive and engage with a second side wall of said coin holder, said second jaw member being so arranged as to permit movement thereof relative to said first jaw member whereby to displace said first and second side walls relative to one another to permit coins within said holder to be released therefrom.

2. An apparatus as defined in claim 1, wherein said first and second jaw members are oriented such that said coin holder is held with its coin-receiving mouth facing in a downward direction, whereby to permit the coins released therefrom to drop in a vertically downward direction.

3. An apparatus as defined in claim 1, wherein said jaw members are elongated and of such length as to extend the major length of the coin holder.

4. An apparatus for handling at least two resilient coin holders of the type having terminal ends and a coin-receiving mouth extending longitudinally thereof and defined by opposed side walls of the holder through which coins are received laterally thereof, comprising in combination:

(a) frame means adapted to receive a plurality of said holders placed linearly in end-to-end arrangement, (b) a first jaw member on said frame means adapted to receive and engage with respective first side walls of the coin holders when placed on said apparatus; and (c) a second jaw member adapted to receive and engage with respective second side walls of said coin holders, said second jaw member being so arranged as to permit movement thereof relative to said first jaw member whereby to displace said respective first and second side walls relative to one another to permit coins within said holders to be released therefrom.

5. An apparatus as defined in claim 1, wherein said first jaw member comprises an elongated channel having one leg thereof extending to a greater extent than the other and terminating in a leg portion inclined and overlying said channel, said second jaw member comprising an elongated channel having one leg thereof extending to a greater extent than the other and terminating in a leg portion inclined and overlying said channel, and said second jaw member having a handle portion which comprises an elongated member, one end of which is secured to said greater extending channel leg, whereby said handle portion extends in a direction away from said channel.

6. An apparatus as defined in claim 5, wherein said frame means comprises a horizontally disposed base plate and a vertically disposed wall portion extending upwardly therefrom adjacent a peripheral edge thereof, the free end of said wall portion terminating in a channel-like configuration, the outer base face of which overlies said base plate in a vertical plane.

7. An apparatus as defined in claim 6, wherein said first jaw member is secured to said outer base face of said channel-like configuration.

8. An apparatus as defined in claim 1, wherein said frame means comprises a pair of handle portions each having a free end, said handle portions being secured respectively to said first jaw and second jaw members, said first and second jaw members being mounted via pivot means to provide a jaw operable in scissors-like fashion upon movement of said handle portions, thus to permit movement of said second jaw member relative to said first jaw member and wherein movement of the free ends of said handle portions in a direction toward one another displaces said first and second side walls relative to one another to permit coins within said holder to be released therefrom.

9. An apparatus as defined in claim 1, including a container adapted to be positioned below said first and second jaw members to receive coins released from the coin holder during said relative movement of said jaw members.

10. An apparatus as defined in claim 9, wherein said container comprises a scoop-like configuration.

11. An apparatus as defined in claim 9, wherein abutment engaging means is provided on said frame means and an abutment is provided on said container for engaging with said abutment engaging means, for locating said container in respect of said frame means.

12. An apparatus as defined in claim 6, wherein said frame means includes a leg portion extending angularly upwardly of said horizontally disposed base plate adjacent a further peripheral edge thereof and being on an opposite side thereof to that of said vertically disposed wall portion, said apparatus including a container adapted to be positioned below said first and second jaw members to receive coins released from the coin holder during said relative movement of said jaw members, said container comprising a scoop-like configuration including a base and having a handle, said container further having an outer surface intermediate said handle and base of the container, which is curved for cooperative engagement with said frame means leg portion for aid in selectively positioning said container relative to said frame means.

13. An apparatus as defined in claim 12, including abutment engaging means on said frame means and an abutment on said container for engaging said abutment engaging means, for locating said container respective said frame means.

14. An apparatus as defined in claim 2, wherein said jaw members are elongated and of such length as to extend the major length of the coin holder.

15. An apparatus as defined in claim 2, wherein said first jaw member comprises an elongated channel having one leg thereof extending to a greater extent than the other and terminating in a leg portion inclined and overlying said channel, said second jaw member comprising an elongated channel having one leg thereof extending to a greater extent than the other and terminating in a leg portion inclined and overlying said channel, sand said second jaw member having a handle portion which comprises an elongated member, one end of which is secured to said greater extending channel leg, whereby said handle portion extends in a direction away from said channel.

16. An apparatus as defined in claim 3, wherein said first jaw member comprises an elongated channel having one leg thereof extending to a greater extent than the other and terminating in a leg portion inclined and overlying said channel, said second jaw member comprising an elongated channel having one leg thereof extending to a greater extent than the other and terminating in a leg portion inclined and overlying said channel, and said second jaw member having a handle portion which comprises an elongated member, one end of which is secured to said greater extending channel leg, whereby said handle portion extends in a direction away from said channel.

17. An apparatus as defined in claim 4, including a container adapted to be positioned below said first and second jaw members to receive coins released from the coin holder during said relative movement of said jaw members.

18. An apparatus as defined in claim 10, wherein abutment engaging means is provided on said frame means and an abutment is provided on said container for engaging with said abutment engaging means, for locating said container in respect of said frame means.

19. An apparatus as defined in claim 7, wherein said frame means includes a leg portion extending angularly upwardly of said horizontally disposed base plate adjacent a further peripheral edge thereof and being on an opposite side thereof to that of said vertically disposed wall portion, said apparatus including a container adapted to be positioned below said first and second jaw members to receive coins released from the coin holder during said relative movement of said jaw members, said container comprising a scoop-like configuration including a base and having a handle, said container further having an outer surface intermediate said handle and base of the container, which is curved for cooperative engagement with said frame means leg portion for aid in selectively positioning said container relative to said frame means.

20. A method of releasing coins from a coin holder of the type having terminal ends and a coin-receiving mouth extending longitudinally thereof and defined by opposed side walls of the holder through which coins are received laterally thereof, comprising the steps of:

(1) orienting the coin holder to place the coin-receiving mouth in a downwardly facing direction;
(2) engaging a first side of the coin-receiving mouth with a first jaw means;
(3) moving said first jaw means with said coin holder toward a second jaw means;
(4) engaging said second jaw means with a second side of the coin-receiving mouth; and
(5) moving said first jaw means to displace said respective sides of the coin-receiving mouth to permit coins in the holder to be released therefrom and move in a downwardly vertical direction.

* * * * *